US007367386B2

(12) United States Patent
Sato et al.

(10) Patent No.: US 7,367,386 B2
(45) Date of Patent: May 6, 2008

(54) AIR COOLED OIL COOLER

(75) Inventors: Junichi Sato, Tokyo (JP); Takeshi Yamaguchi, Tokyo (JP); Tatsuhiro Ozawa, Tokyo (JP); Norimitsu Matsudaira, Tokyo (JP)

(73) Assignee: Calsonic Kansei Corporation, Tokyo (JP)

( * ) Notice: Subject to any disclaimer, the term of this patent is extended or adjusted under 35 U.S.C. 154(b) by 136 days.

(21) Appl. No.: 11/332,288

(22) Filed: Jan. 17, 2006

(65) Prior Publication Data

US 2006/0169445 A1 Aug. 3, 2006

(30) Foreign Application Priority Data

Jan. 28, 2005 (JP) ..... 2005-021867

(51) Int. Cl.
*F28D 1/02* (2006.01)

(52) U.S. Cl. ..... 165/153; 165/175

(58) Field of Classification Search ..... 165/149, 165/152, 153, 173, 175, 916
See application file for complete search history.

(56) References Cited

U.S. PATENT DOCUMENTS

| | | | |
|---|---|---|---|
| 4,332,293 | A | 6/1982 | Hiramatsu et al. |
| 4,693,307 | A | 9/1987 | Scarselletta |
| 5,329,988 | A | 7/1994 | Juger |
| 6,161,616 | A | 12/2000 | Haussmann |
| 2001/0035284 | A1 | 11/2001 | Iwasaki et al. |
| 2002/0153131 | A1 | 10/2002 | Sugawara et al. |
| 2005/0133212 | A1 | 6/2005 | Wilson et al. |

FOREIGN PATENT DOCUMENTS

| | | | |
|---|---|---|---|
| EP | 0 710 811 | A2 | 5/1996 |
| EP | 1 231 446 | A2 | 8/2002 |
| GB | 2 072 316 | A | 9/1981 |
| JP | 09-273883 | A | 10/1997 |
| JP | 11-72295 | A | 3/1999 |
| JP | 11-118366 | A | 4/1999 |
| JP | 2000-146479 | A | 5/2000 |

*Primary Examiner*—Teresa J. Walberg
(74) *Attorney, Agent, or Firm*—Foley & Lardner LLP

(57) ABSTRACT

An air cooled oil cooler has an upper plate, a lower plate and a plurality of tubes and outer fins disposed therebetween. Each tube contains an inner offset fin, and the outer fins formed in a corrugated shape and each having one return louver on an intermediate portion between a top portion and a bottom portion of the outer fin. The outer fins is disposed between the tubes so that the tubes and the outer fins are arranged alternatively and stacked in a pile between the upper and lower plates. The tubes are formed to be flat tubes having a height-width ratio of the tube to be 4.8-7.4%.

6 Claims, 10 Drawing Sheets

AIR COOLED OIL COOLER

BACKGROUND OF THE INVENTION

1. Field of the Invention

The present invention relates to an air cooled oil cooler used for cooling a oil of an engine of a motor vehicle or the like.

2. Description of the Related Art

An air cooled oil cooler is known, which has plural tubes each consisting of a pair of plate members to be coupled and an inner fin disposed in the coupled plate members. The tubes are piled up and formed at their both side ends with a communicating hole to pass an oil among the tubes so that the oil discharged from an engine can be cooled by air flow passing through a space between the tubes while flowing in the tubes and return to the engine for avoiding its overheat.

A conventional air cooled oil cooler of this kind is disclosed in Japanese patents laying-open publication Nos. 2000-146479, Tokkaihei 11-118366, and Tokkaihei 11-72295.

This conventional air cooled oil cooler, however, encounters the following problems. Recently, there is a demand for higher output power of engines, which requires improving coolability of air cooled oil coolers. In order to meet this requirement, the number of a pile of the tubes may be increased in an oil cooler of the above prior arts, but this brings growing in size of a core of the oil cooler.

In addition, there is also a demand for reduction in an engine room according to enlargement of a passenger compartment, which requires smaller air cooled oil coolers.

It is, therefore, an object of the present invention to provide an air cooled oil cooler which overcomes the foregoing drawbacks and can improve its oil coolability with suppression of its size growing.

SUMMARY OF THE INVENTION

According to a first aspect of the present invention there is provided an air cooled oil cooler including an upper plate, a lower plate, a plurality of flat tubes in which an inner offset fin is disposed, a plurality of outer fins formed in a corrugated shape and each having one return louver on an intermediate portion between a top portion and a bottom portion of the outer fin, where the outer fins are disposed between the flat tubes so that the flat tubes and the outer fins are arranged alternatively and stacked in a pile between the upper plate and the lower plate. The flat tubes are formed to have an external height-external width ratio of the flat tube of 4.8-7.4%.

Therefore, the oil cooler can improve its oil coolability and suppress its size growing because of the flat tubes, containing the inner offset fins, having the external height-external width ratio of the flat tube to be 4.8-7.4% and the external height of 2.4-3.7 mm, and the outer fins with the return louver on each intermediate portion.

Preferably, the flat tubes have two communicating holes on each tube to flow oil between the flat tubes therethrough, at least one of the communicating holes of the tubes being blocked by a plug so that the flat tubes are divided into two groups thereof for the oil to meanderingly along the flat tubes.

Therefore, the oil can flow in a long meandering conduit of the tubes and be cooled while flowing therein, which improves the coolability.

Preferably, the return louver is arranged between a plurality of first louvers and a plurality of second louvers which are slanted in directions opposite to each other, the return louver and the first and second louvers being arranged, in use when the cooler is attached to a vehicle body, in a longitudinal direction of the vehicle body.

Therefore, the return louver can flow the air at high speed due to its low flow resistance, which improves the coolability.

BRIEF DESCRIPTION OF THE DRAWINGS

The objects, features and advantages of the present invention will become apparent as the description proceeds when taken in conjunction with the accompanying drawings, in which:

FIG. 3A is an exploded cross sectional view of the tube before assembled, and FIG. 3B is a cross sectional view of the tube after assembled;

DETAILED DESCRIPTION OF THE PREFERRED EMBODIMENTS

Figure 1:
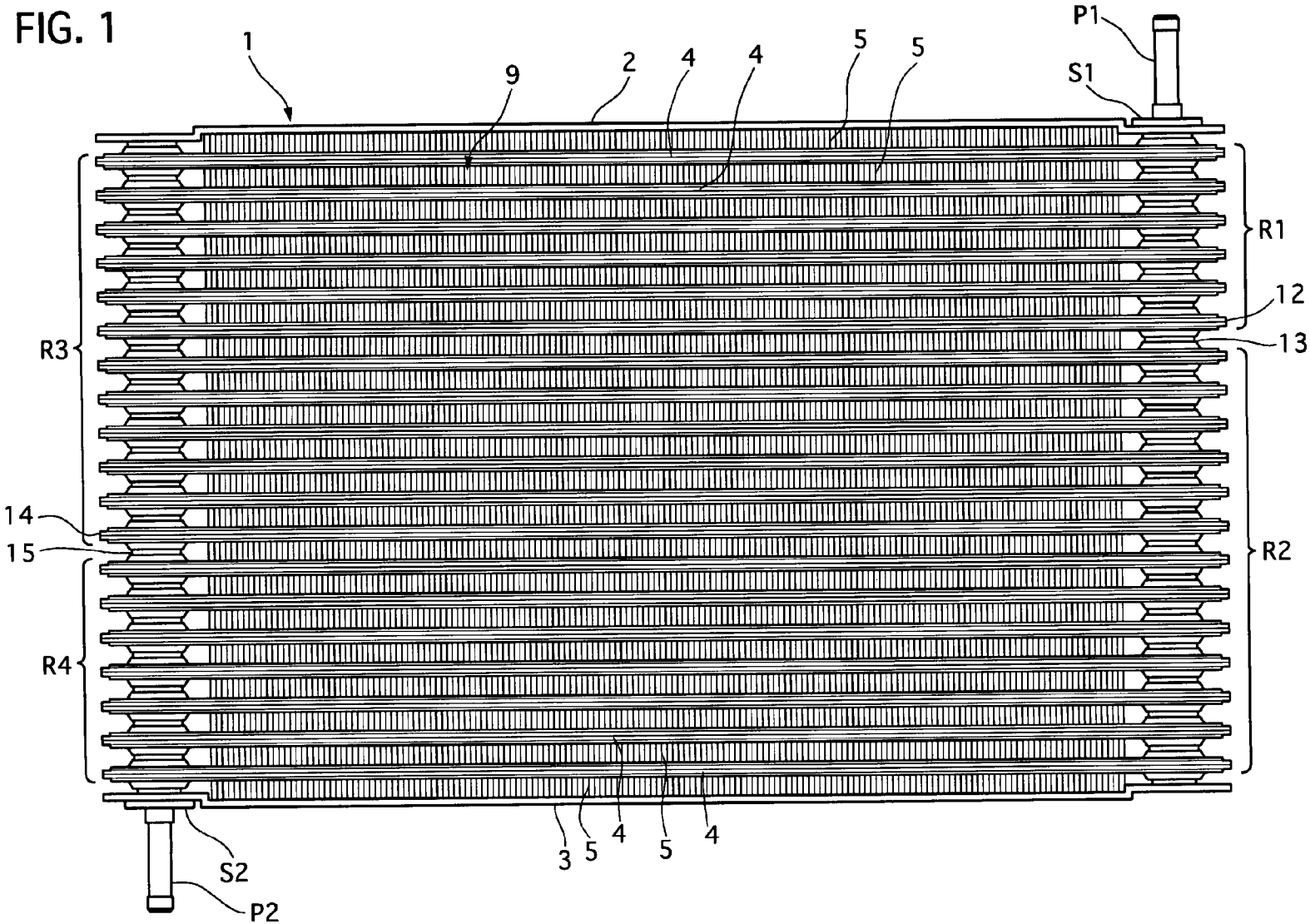
FIG. 1 is a front view showing an entire construction of an air cooled oil cooler of an embodiment according to the present invention.

Throughout the following detailed description, similar reference characters and numbers refer to similar elements in all figures of the drawings, and their descriptions are omitted for eliminating duplication.

Figure 2:
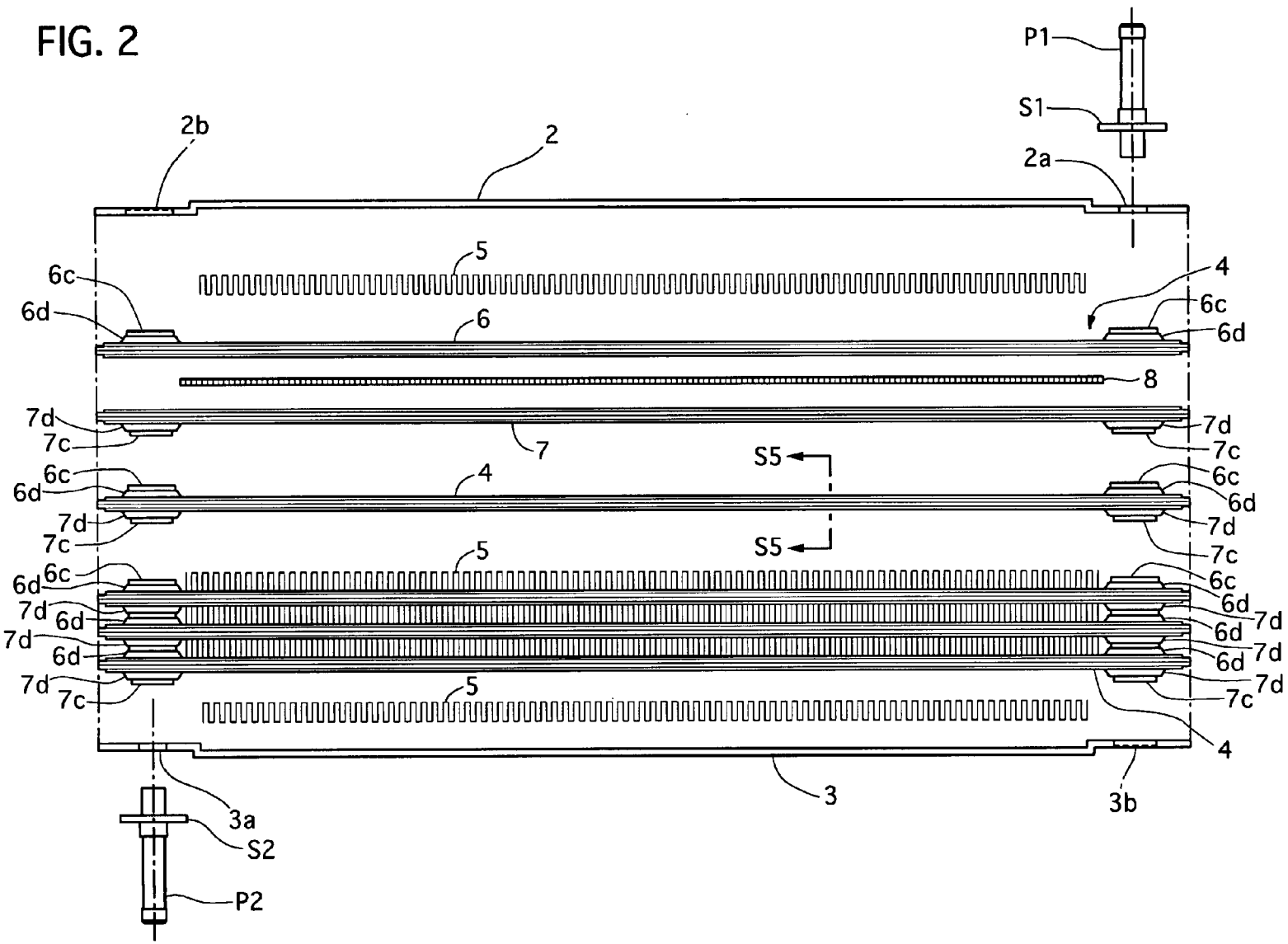
FIG. 2 is an exploded front view of the air cooled oil cooler shown in FIG. 1.

Referring to FIGS. 1 and 2, there is shown an air cooled oil cooler 1 of an embodiment according to the present invention.

The air cooled oil cooler 1 includes an upper outer plate 2 and a lower outer plate 3, between which a plurality of tubes 4 and outer fins 5 are disposed so in a state where the tube 4 and the outer fin 5 are arranged alternatively and stacked in a pile.

The upper outer plate 2 is formed with a through-hole 2*a* at its one end portion and with a round dent 2*b* at its other end portion. The through-hole 2*a* fixes an inlet pipe P1 through a circular sheet member S1, and the round dent 2*b* receives a connecting portion 6*c* of an upper plate member 6 of the tube 4. The inlet pipe P1 is connected with an oil outlet port of a not-shown engine through a not-shown tube.

The lower outer plate member 3 is formed with a through-hole 3*a* at its one end portion opposite to the end portion with the through-hole 2*a* of the upper outer plate 2 and with a round detent 3*b* at its other end portion. The through-hole 3*a* fixes an outlet pipe P2 through a circular sheet member S2, and the round detent 3*b* receives a connecting portion 7*c* of a lower plate member 7 of the tube 4. The outlet pipe P2 is connected with an oil inlet port of the engine through another tube.

Figure 3A:
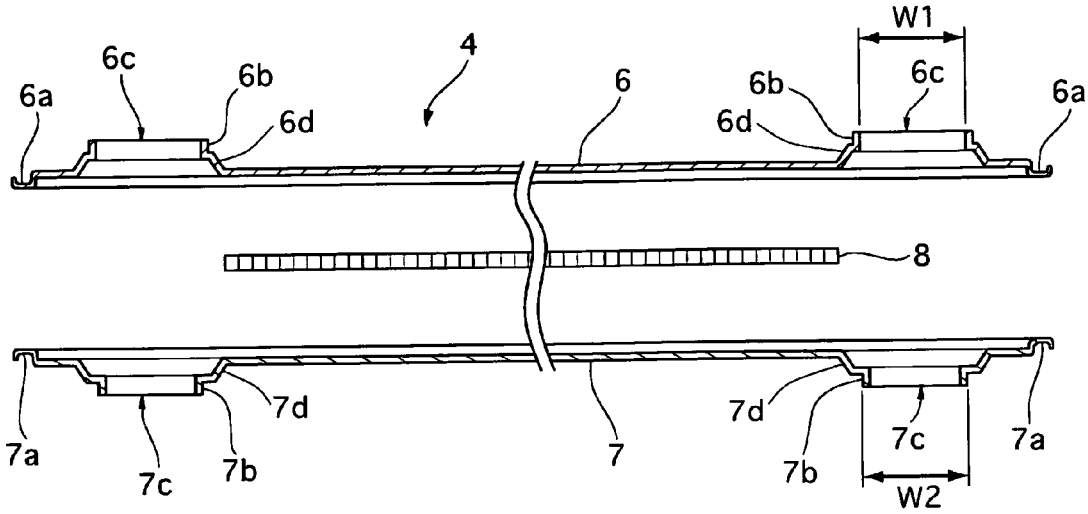
FIGS. 3A and 3B are front views of a tube used in the air cooled oil cooler shown in FIG. 1 and having a pair of plate members and an inner fin.
Figure 3B:
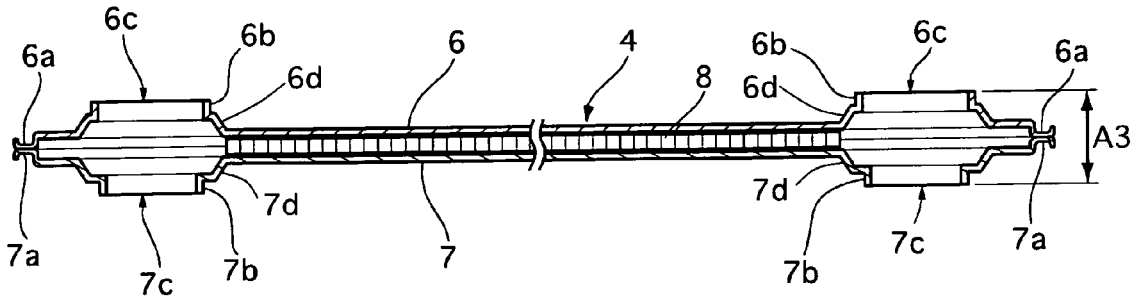

As shown in FIG. 3A, the tube 4 has the upper plate member 6 and the lower plate member 7, which are coupled with each other to form a flat boxy shape having a space therein to contain an inner fin 8 as shown in FIG. 3B. The upper and lower plate members 6 and 7 have substantially the same length and width as the upper and lower outer plates 2 and 3.

The upper plate member 6 is formed at both end portions with a flange portion 6*a* and the connecting portion 6*c* located nearer to a center portion of the upper plate member 6 than the flange portion 6*a* and at a position corresponding to that of the through-hole of the upper outer plate 2 when they are assembled. The connecting portion 6*c* consists of a circular cylinder portion 6*b* and a tapered portion 6*d* which are formed on an outer surface of the upper plate member 6 so as to connect the tubes 4 and flow engine oil between the tubes 4 through the connecting portions 6*b*.

The lower plate member 7 is formed at both end portions with a flange portion 7*a* and the connecting portion 7*c* located nearer to a center portion of the lower plate member 7 than the flange portion 7*a* and at a position corresponding to that of the through-hole of the lower outer plate 3 when they are assembled. The connecting portion 7*c* consists of a circular cylinder portion 7*b* and a tapered portion 7*d* which are formed on an outer surface of the lower plate member 7. An outer diameter W2 of the circular cylinder portion 7*b* of the lower plate member 7 is set to be smaller than an inner diameter W1 of the circular portion 6*b* of the upper plate member 6 so that the connecting portion 7*c* can be inserted and fitted into and to the connecting portion 6*c*.

The thus formed upper and lower plate members 6 and 7 are coupled with each other to form the tube 4 containing the inner fin 8. In this embodiment, for example, nineteen tubes 4 are piled up by joining the connecting portions 6*c* and 7*c*, sandwiching the outer fin 5, which provides a core 9 of the oil cooler 1 shown in FIGS. 1 and 4. The outer fins 5 are disposed between the first tube 4 and the upper outer plate 2 and between the nineteenth tube 4 and the lower outer plate 3, respectively.

Figure 4:
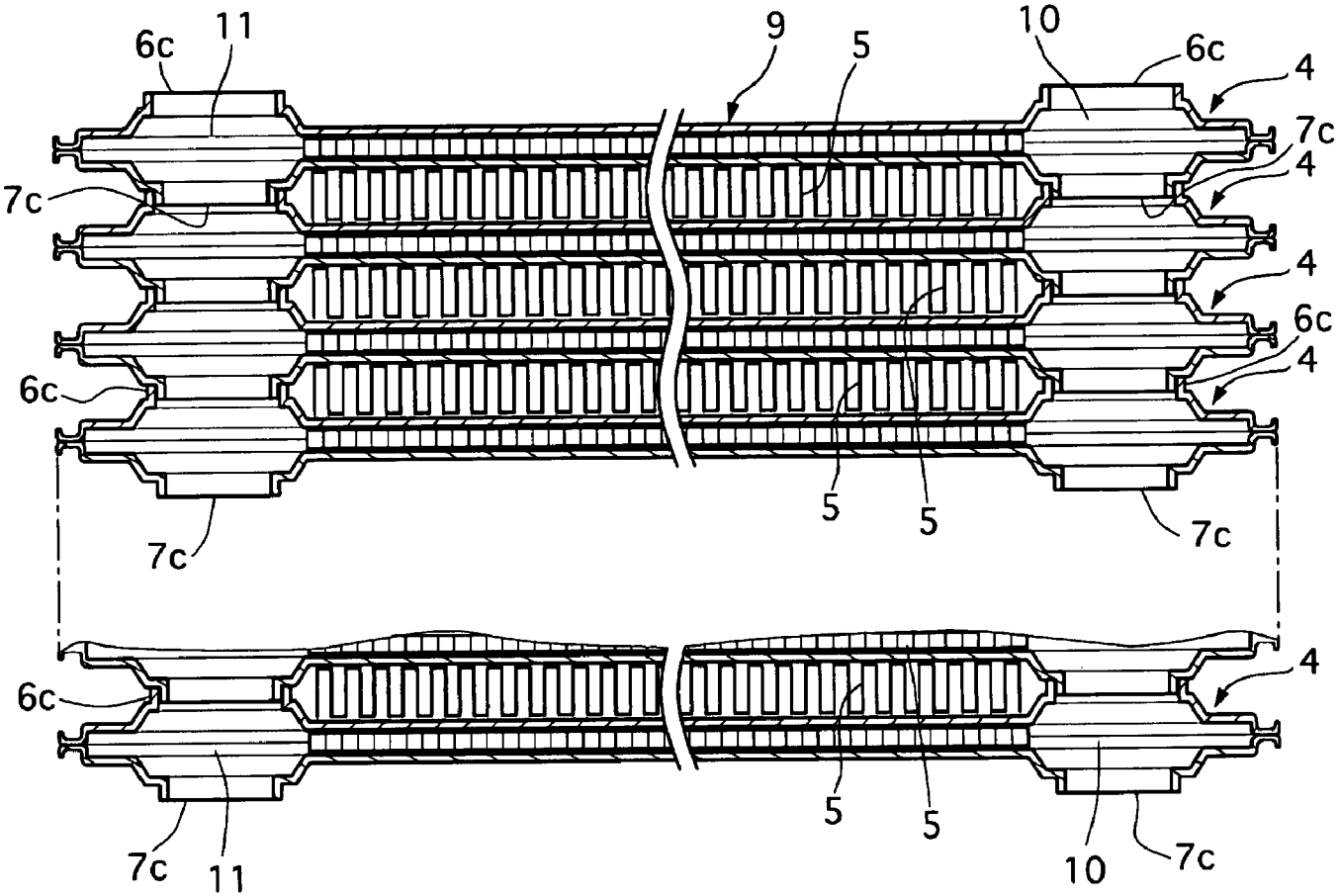
FIG. 4 is a cross sectional front view of a pile of tubes and outer fins used in the oil cooler shown in FIGS. 1.
Figure 5:
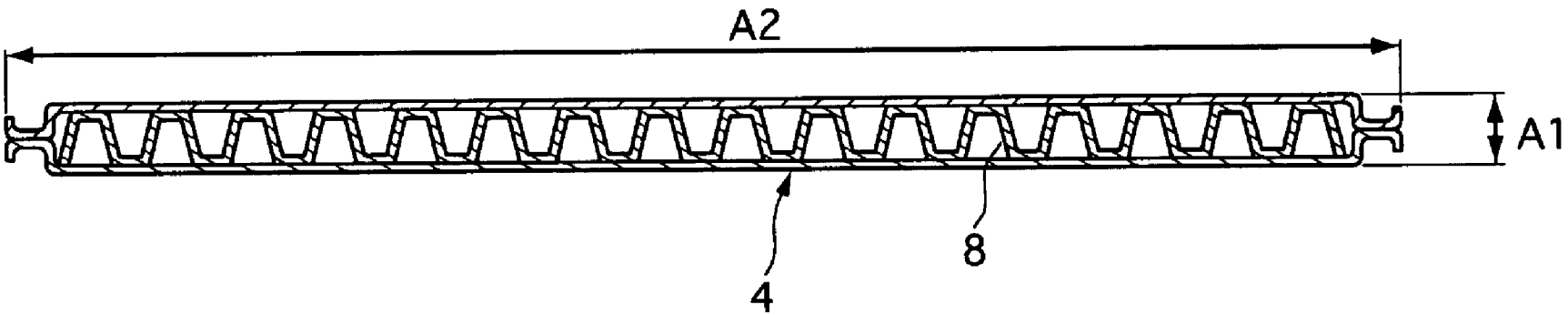
FIG. 5 is a cross sectional side view of the tube taken along a line S5-S5 in FIG. 2.

At the both sides of the core 9, communicating holes 10 and 11 are Respectively formed through the right and left connecting portions 6*c* and 7*c* so that an engine oil can flow from one tube to another through the holes 10 and 11 as shown in FIG. 4.

The right connecting portion 7*c* of the sixth tube 12 is fluidically blocked by a plug 13, which divides the core 9 into a first room R1 and a second room R2. Similarly, the left connecting portion 7*c* of the twelfth tube 14 is fluidically blocked by a plug 15, which divides the core 9 into a third room R3 and a fourth room R4. The number of the plugs and their positions may be arbitrarily set according to a demand.

The tubes 4 are formed in a flat boxy shape, which is set to have a compression ratio A1/A2×100=4.8-7.4%, where A1 is an external height of the tube 4 and A2 is an external width of the tube 4.

In this embodiment, A1 is 2.5 mm, a half of the height of the conventional oil coolers. Preferably, A1 is set at 2.4 mm -3.7 mm, since oil flow resistance exceeds its proper amount when A1 is smaller than 2.4 mm and the core 9 cannot attain a desirable coolability because of its size enlargement when A1 exceeds 3.7 mm. On the other hand, A2 is 50 mm similarly to that of conventional oil coolers, and may be set arbitrarily as long as it meets the requirements of A1/A2=4.8-7.4%. The height A3 of the tube 4, corresponding to a length between the connecting portions 6*c* and 7*c* as shown in FIG. 3B, is 9.7 mm, greatly smaller than that (14.6 mm) of the conventional oil coolers.

Figure 6:
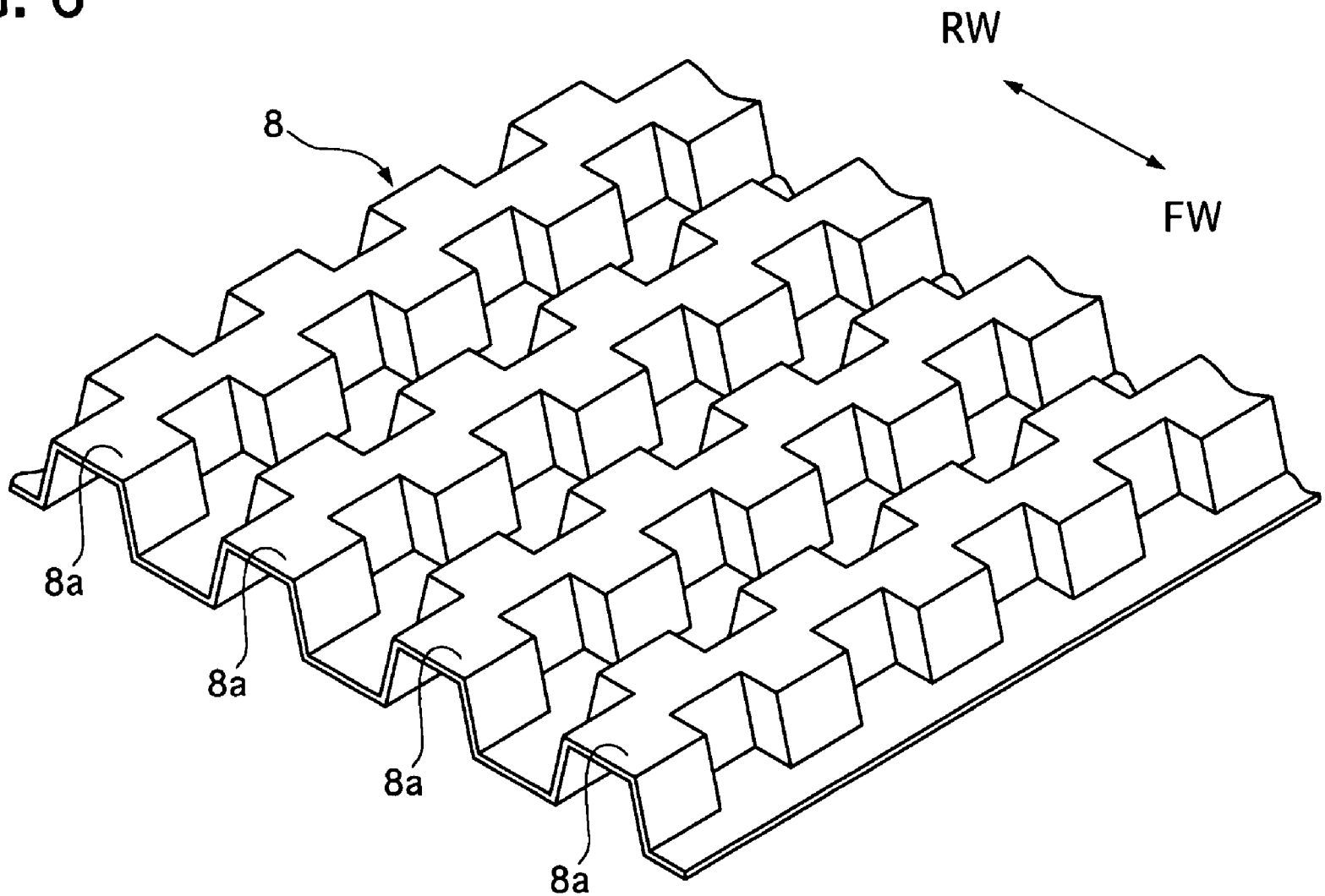
FIG. 6 is an enlarged perspective view of the inner fin shown in FIGS. 2-4.

FIG. 6 shows the inner fin 8, which has plural rows of projecting portions 8*a* to extend in a lateral direction of a not-shown vehicle body when the oil cooler 1 is attached to the vehicle body. Each projecting portion 8*a* is formed to have plural continuous parts offset alternatively in a forward direction FW of the vehicle body and in a rearward direction RW thereof, and accordingly, the inner fin 8 is, what is called, an offset fin.

Figure 7:
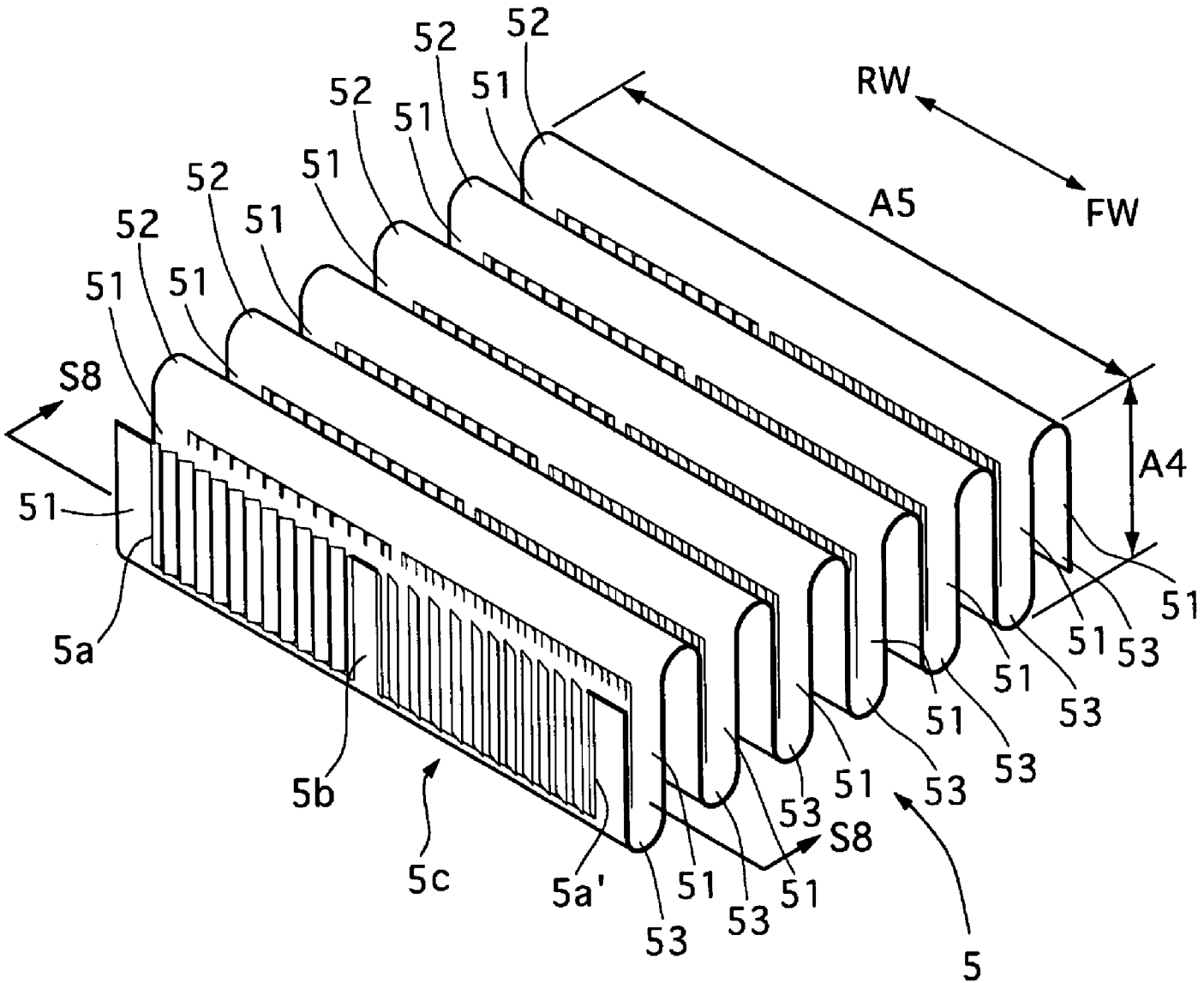
FIG. 7 is an enlarged perspective view of the outer fin.
Figure 8:
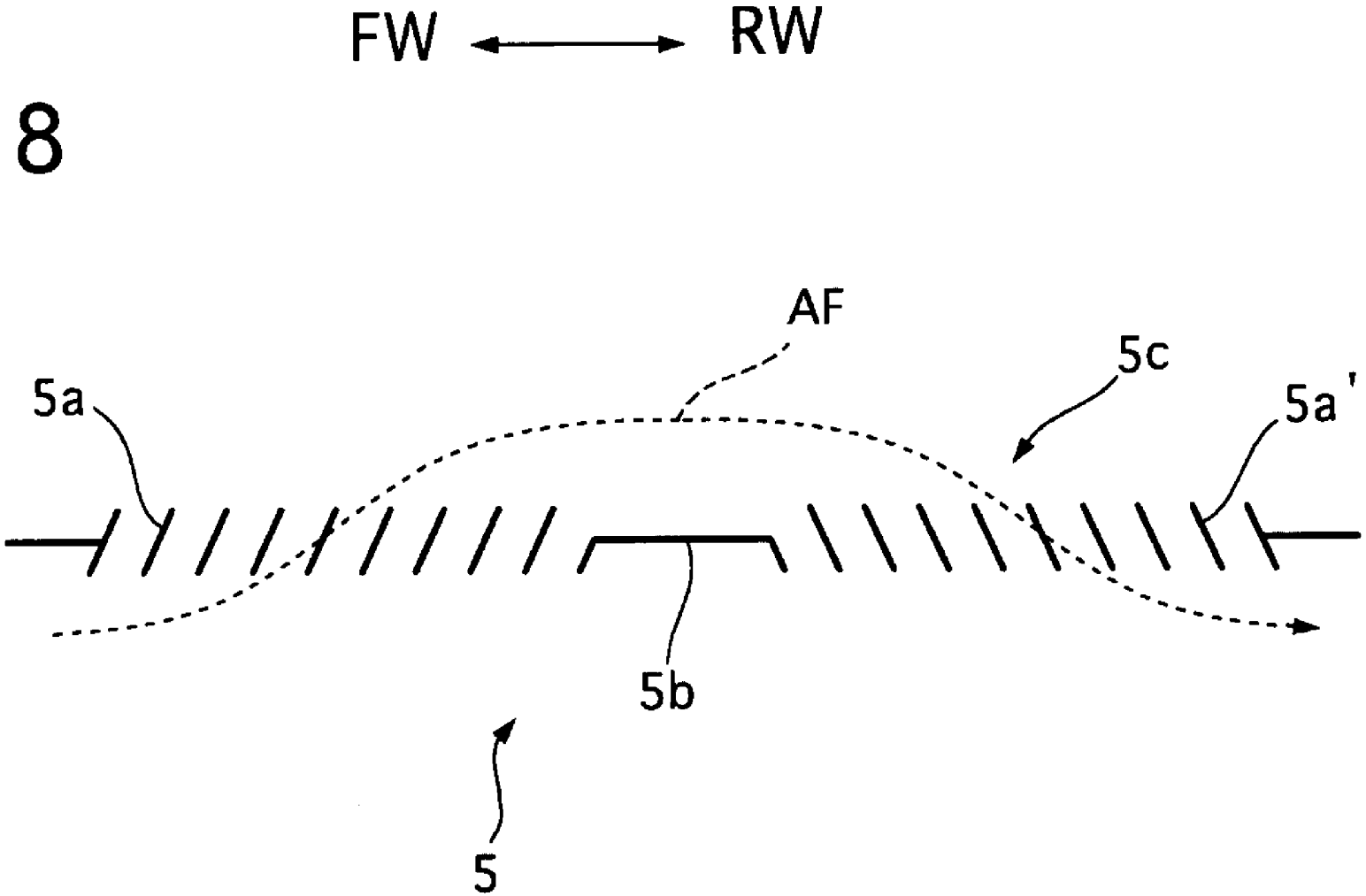
FIG. 8 is a schematic diagram illustrating airflow and louvers formed on each intermediate portion of the outer fin taken along a line S8-S8 in FIG. 7.

FIGS. 7 and 8 show the outer fin 5, which is a corrugated fin with a plurality of louvers 5*c* formed on each intermediate portion 51 between top portions 52 and bottom portions 53 of the outer fin S. The louvers 5*c* consist of first plural louvers 5*a* and second louvers 5*a*' respectively arranged at a front side and rear side of each intermediate portion 51 of the outer fin 5 and a return louver 5*b* sandwiched by the first and second louvers 5*a* and 5*a*'. The first and second louvers 5*a* and 5*a*' are slanted in directions opposite to each other. These opposite slants of the first and second louvers 5*a* and 5*a*' suppress bending of the outer fin 5 due to its residual stress caused by forming the louvers 5*a* and 5*a*'. The return louver 5*b* has both edge portions, which are slanted in parallel with the first and second louvers 5*a* and 5*a*', respectively, so that air flow AF can pass through the first louvers 5*a* and the second louvers 5*a*' flowing along a passage shaped in the letter U smoothly. There is only one return louver 5*b*, which decreases air flow resistance compared to a fin with plural return louvers.

In this embodiment, the height A4 of the outer fin 5 is 6.5 mm, and the width AS is 50 mm. Preferably, A4 is set at 6-7.3 mm lower than that (10 mm of conventional outer fins.

Two outer fins 5 located between the upper outer plate 2 and the first tube 4 and between the lower outer plate 3 and the nineteenth tube 4 are set shorter in length than the other outer fins to ensure spaces for the both stepped end portions of the upper and lower outer plates 2 and 3, respectively.

All parts of the air cooled oil cooler 1 of the embodiment are made of aluminum, and cladding layer (brazing sheet) made of brazing filler material is formed on at least one part of their joining portions of the parts.

The oil cooler 1 is assembled as follows.

Referring to FIGS. 2, 3A and 3B, at first, the tubes 4 are obtained by joining the upper plate members 6 and the lower plate members 7 in a state that the inner fin 8 are inserted between the plate members 6 and 7. Then, the tubes 4 and the outer fins 5 are arranged alternatively and stacked in a pile by inserting the connecting portions 7*c* of the tube 4 into the connecting portions 6*c* of the next tube 4, thereby forming the core 9. In this case, a not-shown circular sheet member may be disposed between the connecting portions 7*c* and the connecting portions 6*c* to ensure a desirable space between the tubes 4 adjacent to each other.

The upper outer plate 2 and the lower outer plate 3 are arranged on the first tube 4 and the nineteenth tube 4, respectively, in a state that the outer fins 5 are disposed between the upper outer plate 2 and the first tube 4 and between the lower outer plate 3 and the nineteenth tube 4.

The inlet pipe P1 is inserted into the through-hole 2*a* of the upper outer plate 2 through the circular sheet member S1, the outlet pipe P2 is inserted into the through-hole 3*a* of the lower outer plate 3.

Thus-temporarily-assembled oil cooler 1 is located into a not-shown heating furnace, where it is heated so that its portions to be connected with each other are joined by brazing.

The operation of the air cooled oil cooler of the embodiment will be described.

Figure 9:
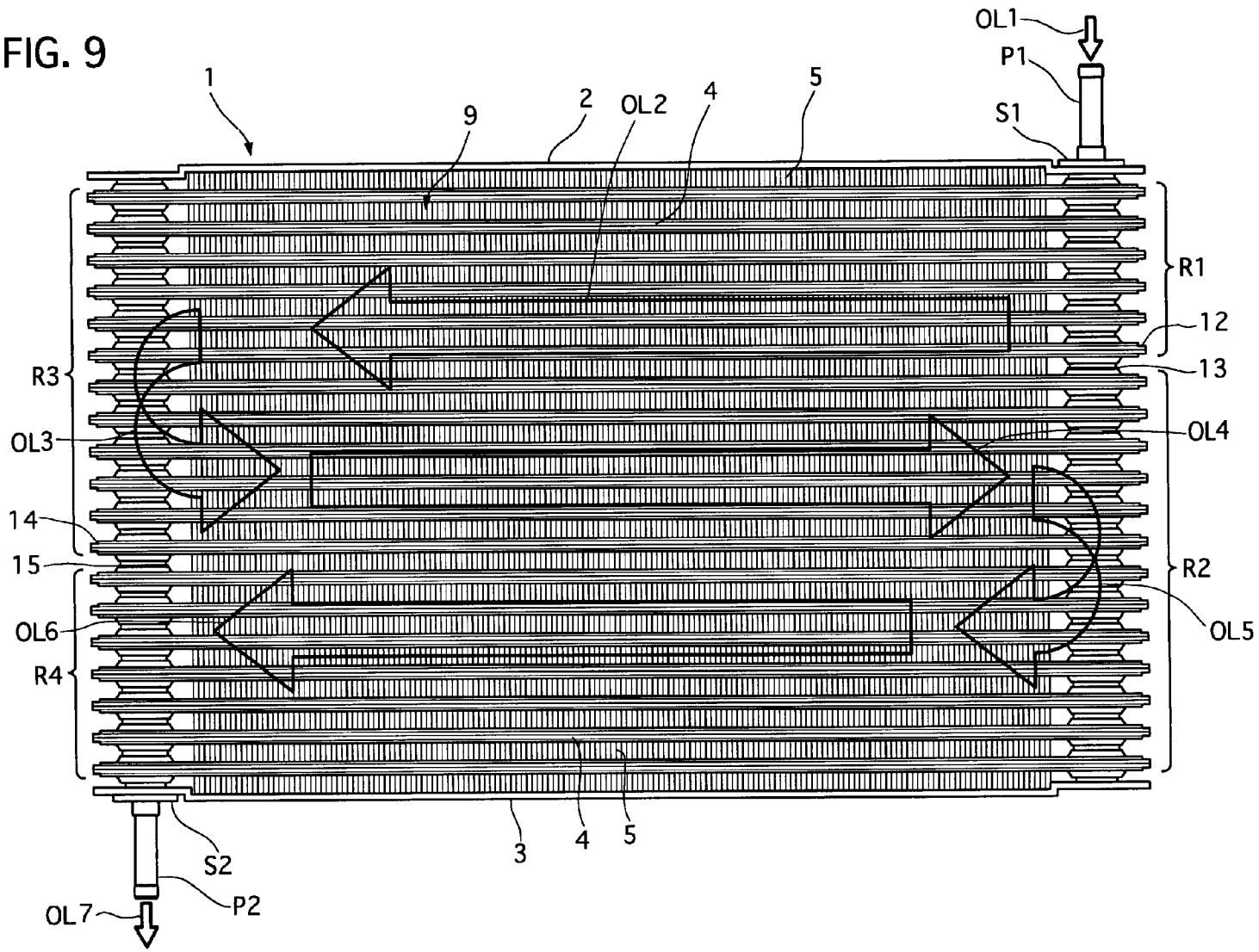
FIG. 9 is a front view showing an oil flow in the oil cooler shown in FIG. 1.

FIG. 9 shows an oil flow in the air cooled oil cooler 1. The hot oil discharged from the engine is introduced to the inlet pipe P1 as indicated by an arrow OL1, and enters the first room R1 (the first to sixth tubes 4) of core 9. In this first room R1, oil flows horizontally from the right side toward the left side of the core 9, an upper part (the first to sixth tubes 4) of the third room R3 (the first to twelfth tubes 4), as indicated by an arrow OL2, where the oil is cooled. Note that some oil flows downwardly through the communicating holes 10 within the first room R1 and then horizontally toward the left.

Subsequently, the oil flows downwardly from the upper part of the third room R3 toward a lower part (the seventh to twelfth tubes 4) of the third room R3 through the communicating holes 11 as indicated by an arrow OL3.

The oil in the lower part of the third room R3 flows horizontally from the left side toward the right side, an upper part (the seventh to twelfth tubes 4) of the second room R2 (the seventh to nineteenth tubes 4) to be cooled further as indicated by an arrow OL4, and then flows downwardly to a lower part (the thirteenth to nineteenth tubes 4) of the second room R2 through the communicating holes 10 as indicated by an arrow OL5.

The oil in the lower part of the second room R2 flows horizontally from the right side toward the left side, the fourth room R4 (the thirteenth to nineteenth tubes 4) as indicated by an arrow OL6, where the oil is cooled further. Then, it flows out from the core 9 through the outlet pipe P2 as indicated by an arrow OL7, then to the engine through the not-shown tube.

The oil flowing in the tubes 4 is diffused in plural possible directions by the inner offset fins 8 and accordingly cooled effectively.

In addition, the outer fins 5 causes the air to flow at high speed along the letter U by the louvers 5*a*, 5*a*' and 5*b*, thereby increasing heat exchanger effectiveness of the oil.

The core 9 enables the oil to flow meandering in its long conduit and be cooled to a large extent.

The air cooled oil cooler of the first embodiment has the following advantages.

Figure 10:
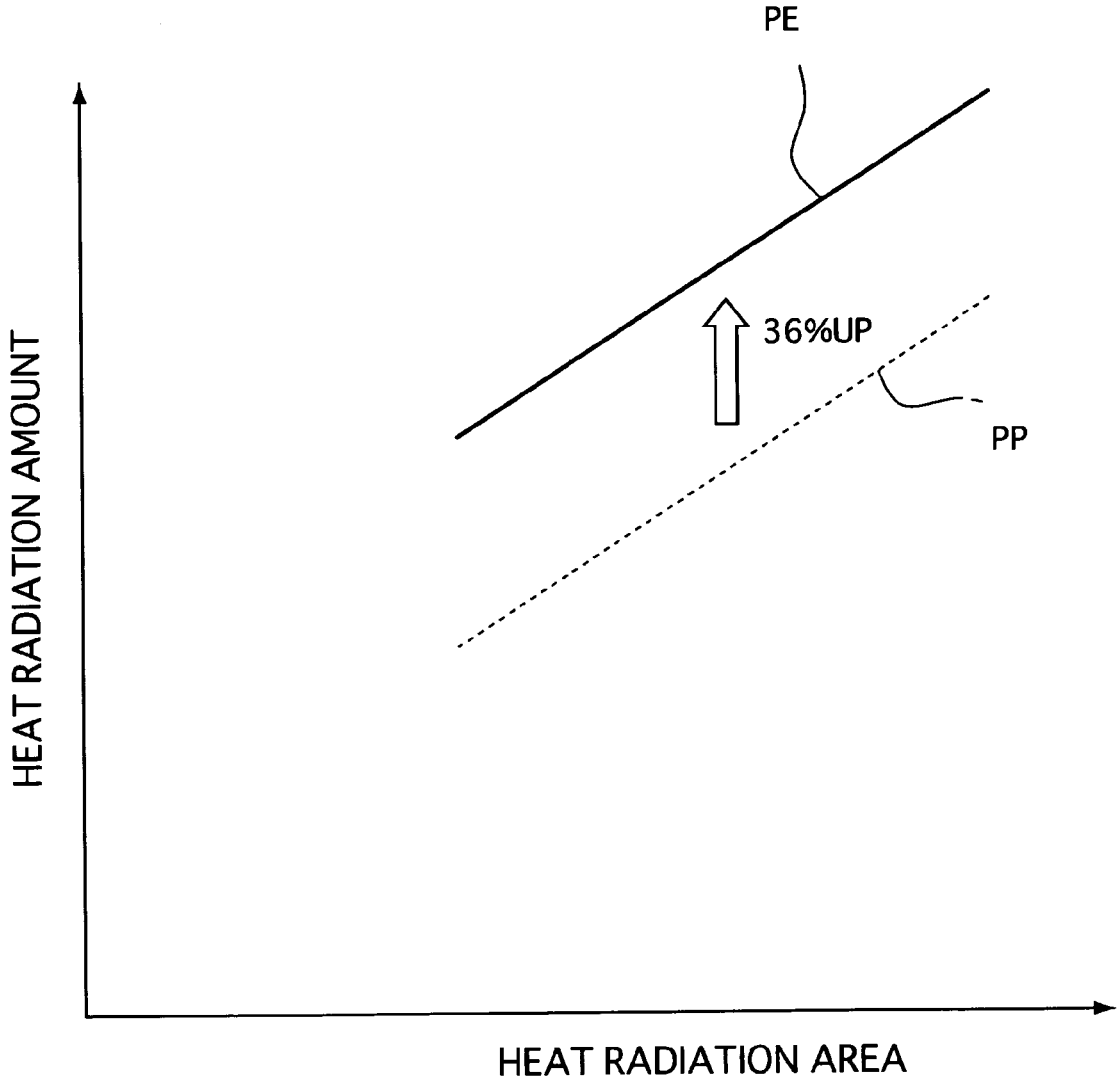
FIG. 10 is a diagram showing relationships between a heat radiation area and a heat radiation amount per unit area to compare coolability of the embodiment and the conventional oil coolers.

The core 9 of the oil cooler 1 is constructed to have the plural flat tubes 4 with the compression ratio A1/A2×100=4.8-7.4% and the outer fins 5 so that they are arranged alternatively and stacked in a pile. This enabled the oil cooler 1 to improve its coolability to a large extent, approximately 36% higher than that of the conventional oil coolers, suppressing its size growing compared to them, as shown in FIG. 10. The pile number of sets of a tube and outer fin is limited to only thirteen in the conventional oil coolers, while that of the embodiment in the same size is nineteen.

FIG. 10 shows a relationship between a heat radiation area of the core 9 and a heat radiation amount per unit area therefrom, where a line PE indicates the coolability of the oil cooler of the embodiment and a line PP indicates that of an oil cooler of the prior arts. This relationship is obtained based on the experimental results using the oil cooler of the embodiment and the prior oil cooler.

The prior oil cooler is used, which is provided with tubes of A1=4.6 mm and A2=50 mm with a corrugated inner fin and no plug in communicating holes and outer fins of 10 mm height and 50 mm width with three sets of return louvers on each intermediate portion of the outer fin.

In another words, the oil cooler 1 can be decreased in size to obtain coolability similar to those of the conventional oil coolers.

The communicating holes formed on the tubes 4 for fluidically communicating the adjacent tubes 4 is blocked by the plugs 13 and 15 so that the core 9 is divided into two or more than two rooms in a piling-up direction. This brings a long meandering oil conduit, thereby increasing the coolability of the core 9. The coolability is also increased by the inner offset fins 8 for diffusing the oil in the tubes 4.

The outer fins 5 is formed with one return louver 5*b* at each intermediate portion 51 of the outer fin 5, so that the air can flow at high speed between the tubes 4 due to its low flow resistance, which further improves the coolability.

While there have been particularly shown and described with reference to preferred embodiments thereof, it will be understood that various modifications may be made therein, and it is intended to cover in the appended claims all such modifications as fall within the true spirit and scope of the invention.

The number of the tubes and outer fins may be set arbitrarily according to a demand for coolability of an air cooled oil cooler.

The number and position of the plug may be also set arbitrarily according to a demand for coolability of an air cooled oil cooler.

The inlet pipe P1 and the outlet pipe P2 are fixed to the upper plate 2 and the lower plate 3, respectively, in the embodiment, but an inlet pipe and an outlet pipe may be fixed to a lower plate and an upper plate, respectively, so that oil can flow from a lower part toward an upper part of a core.

The tubes 4, inner fins 8, outer fins 5 may be made of aluminum or aluminum base alloy.

The entire contents of Japanese Patent Application No. 2005-021867 filed Jan. 28, 2005 is incorporated herein by reference.

What is claimed is:

1. An air cooled oil cooler comprising:

an upper plate;

a lower plate;

a plurality of flat tubes in which an inner offset fin is disposed; and a plurality of outer fins formed in a corrugated shape and each provided with one return louver on an intermediate portion between a top portion and a bottom portion of the outer fin, the outer fins being disposed between the flat tubes so that the flat tubes and the outer fins are arranged alternatively and stacked in a pile between the upper plate and the lower plate, wherein each flat tube has an external height-external width ratio of the flat tube of 4.8-7.4%.

2. The air cooled oil cooler of claim 1, wherein the flat tubes have two communicating holes on each tube to flow oil between the flat tubes therethrough, at least one of the communicating holes of the tubes being blocked by a plug such that the flat tubes are divided into two groups thereof for the oil to flow meanderingly along the flat tubes.

3. The air cooled oil cooler of claim 2, wherein the return louver is arranged between a plurality of first louvers and a plurality of second louvers which are slanted in directions opposite to each other, the return louver and the first and second louvers being arranged, in use when the cooler is attached to a vehicle body, in a longitudinal direction of the vehicle body.

4. The air cooled oil cooler of claim 1, wherein the return louver is arranged between a plurality of first louvers and a plurality of second louvers which are slanted in directions opposite to each other, the return louver and the first and second louvers being arranged, in use when the cooler is attached to a vehicle body, in a longitudinal direction of the vehicle body.

5. The air cooled oil cooler of claim 1, wherein each flat tube has an external height of 2.4-3.7 mm.

6. The air cooled oil cooler of claim 1, wherein each flat tube has an external width of 32.4-77.1 mm.

* * * * *